US007887469B1

(12) United States Patent
Chen

(10) Patent No.: US 7,887,469 B1
(45) Date of Patent: Feb. 15, 2011

(54) ADJUSTABLE DUMBBELL

(76) Inventor: Paul Chen, 7771 Goldstream Dr., Richmond, Vancouver, BC (CA) V7A 1S5

( * ) Notice: Subject to any disclaimer, the term of this patent is extended or adjusted under 35 U.S.C. 154(b) by 0 days.

(21) Appl. No.: 12/804,797

(22) Filed: Jul. 28, 2010

(51) Int. Cl.
*A63B 21/072* (2006.01)
*A63B 21/075* (2006.01)

(52) U.S. Cl. ..... 482/108; 482/107

(58) Field of Classification Search ..... 482/92–98, 482/104–109, 908; D21/680–682; *A63B 21/072, A63B 21/075*
See application file for complete search history.

(56) References Cited

U.S. PATENT DOCUMENTS

| | | | | |
|---|---|---|---|---|
| 2,640,696 | A * | 6/1953 | Lemieux | 482/107 |
| 4,566,690 | A | 1/1986 | Schook | |
| 5,135,455 | A | 8/1992 | King et al. | |
| 5,180,352 | A | 1/1993 | Sreter | |
| 5,242,350 | A | 9/1993 | Chang | |
| 5,250,014 | A | 10/1993 | Chang | |
| 6,656,093 | B2 | 12/2003 | Chen | |
| 6,971,974 | B2 * | 12/2005 | Bowman et al. | 482/107 |
| 7,087,000 | B1 * | 8/2006 | Walker | 482/107 |
| 7,137,932 | B2 * | 11/2006 | Doudiet | 482/107 |
| 7,413,533 | B2 * | 8/2008 | Lin | 482/108 |
| 7,429,235 | B2 * | 9/2008 | Lin | 482/108 |
| 7,578,772 | B2 * | 8/2009 | Lippitt | 482/108 |
| 7,604,577 | B2 * | 10/2009 | Lin | 482/108 |
| 7,731,641 | B1 | 6/2010 | Chen | |
| 7,811,213 | B2 * | 10/2010 | Chen | 482/108 |
| 2003/0096680 | A1 * | 5/2003 | Nethery | 482/92 |

* cited by examiner

*Primary Examiner*—Loan Thanh
*Assistant Examiner*—Daniel F Roland
(74) *Attorney, Agent, or Firm*—Charles E. Baxley

(57) ABSTRACT

An adjustable barbell or dumbbell or exercise device includes a handle, two carriers each having a tubular member attached to the end portion of the handle and each having a number of slots, a number of weight members attachable onto the tubular member of the carrier, and two latch members each having a shank engaged into the tubular member and each having a number of latch tongues extendible out through the slots of the carrier for engaging with the weight members and for anchoring the weight members on the carrier and the handle, and the latch tongues are selectively engageable into the tubular member of the carrier for allowing the weight members to be attached to and disengaged from the carrier and the end portion of the handle.

4 Claims, 6 Drawing Sheets

ADJUSTABLE DUMBBELL

BACKGROUND OF THE INVENTION

1. Field of the Invention

The present invention relates to an adjustable barbell or dumbbell or exercise device, and more particularly to an adjustable barbell or dumbbell or exercise device including an improved structure for allowing the weight members to be easily and adjustably attached to or disengaged from the weight carrier or handle and for allowing the adjustable dumbbell to be easily operated by the users.

2. Description of the Prior Art

Typical barbells or dumbbells comprise a handle to be grasped or held by the user, and a number of weight plates to be attached onto the ends of the handle for weight lifting or exercising purposes, or for exercising or training the upper muscle groups or the lower muscle groups of the user.

For example, U.S. Pat. No. 4,566,690 to Schook, U.S. Pat. No. 5,135,455 to King et al., U.S. Pat. No. 5,180,352 to Sreter, and U.S. Pat. No. 5,242,350 to Chang disclose several typical adjustable dumbbells each comprising two or more weight plates or weight members selectively or adjustably attaching or mounting onto the handle shaft or handle bar for being held or grasped by the users to train the upper muscle groups or the lower muscle groups of the user.

However, the weight plates or weight members are normally attached or mounted onto the handle shaft or handle bar with a threading engagement such that it takes a long time to thread and unthread the weight plates or weight members onto or from the handle shaft or handle bar.

U.S. Pat. No. 5,250,014 to Chang discloses another typical adjustable dumbbell comprising two spherical shells joined by a short bar with lock screw bolts for receiving or attaching counter weights within the spherical shells.

However, it also takes a long time to thread and unthread the lock screw bolts relative to the spherical shells in order to attach or mount the weight plates or weight members onto or from the spherical shells.

U.S. Pat. No. 6,656,093 to Chen discloses a further typical dumbbell comprising a handle which can be grasped or held by the user, a number of weight plates to be attached onto the ends of the handle for exercising or training the arms or the feet of the user, and a latch attached onto the end of the handle and/or the weighted plates for selectively or adjustably mounting or securing the weighted plates on the ends of the handle.

However, the latch may not be easily or quickly assembled onto the handle or the weighted plates such that the typical adjustable dumbbell may not be easily or quickly assembled or manufactured.

U.S. Pat. No. 7,731,641 to Chen discloses a still further typical adjustable dumbbell comprising a series of weighted plates to be attached onto the ends of the handle, and a lock nut should be attached onto the ends of the handle for selectively or adjustably mounting or securing or anchoring the weighted plates on the ends of the handle.

However, it also takes a long time to thread and unthread the lock nuts relative to the handle in order to attach or mount the weight plates or weight members onto or from the ends of the handle.

The present invention has arisen to mitigate and/or obviate the afore-described disadvantages of the conventional adjustable dumbbells.

SUMMARY OF THE INVENTION

The primary objective of the present invention is to provide an adjustable barbell or dumbbell including an improved structure for allowing the weight members to be easily and adjustably attached to or disengaged from the weight carrier or handle and for allowing the adjustable dumbbell to be easily operated by the users.

In accordance with one aspect of the invention, there is provided an adjustable exercise device comprising a handle including two end portions, two carriers each including a tubular member attached to the end portion of the handle respectively, and each including a non-circular cross section, and each including a chamber formed therein, and each including a number of slots formed therein and communicative with the chamber of the tubular member, a number of weight members each including an opening formed therein for slidably receiving the tubular member of the carrier, and two latch members each including a shank engaged into the chamber of the tubular member, and each including a bore formed therein for engaging with the end portion of the handle and for attaching onto the handle, and each including a number of latch tongues extended outwardly therefrom and aligned with the slots of the carrier respectively, and the latch member being rotatable relative to the carrier and the handle for selectively extending the latch tongues out through the slots of the carrier respectively and for selectively engaging with the weight members for anchoring and latching the weight members on the carrier and the handle, and the latch member being rotatable relative to the carrier and the handle for selectively engaging the latch tongues into the tubular member of the carrier and for allowing the weight members to be selectively attached to and disengaged from the carrier and the end portion of the handle.

The handle includes a pin member engaged with the shank of the latch member for limiting the latch member to rotate relative to the carrier and the handle.

The latch member includes two opposite grooves formed in the shank for slidably engaging with the lock pin member and for pivotally attaching the latch member to the carrier and the handle and for limiting the latch member to rotate relative to the carrier and the handle.

The carriers each include a base plate provided on one end of the tubular member and having an outer diameter greater than that of the tubular member for engaging with the weight members and for anchoring or positioning or retaining the weight members on the tubular member and the handle.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
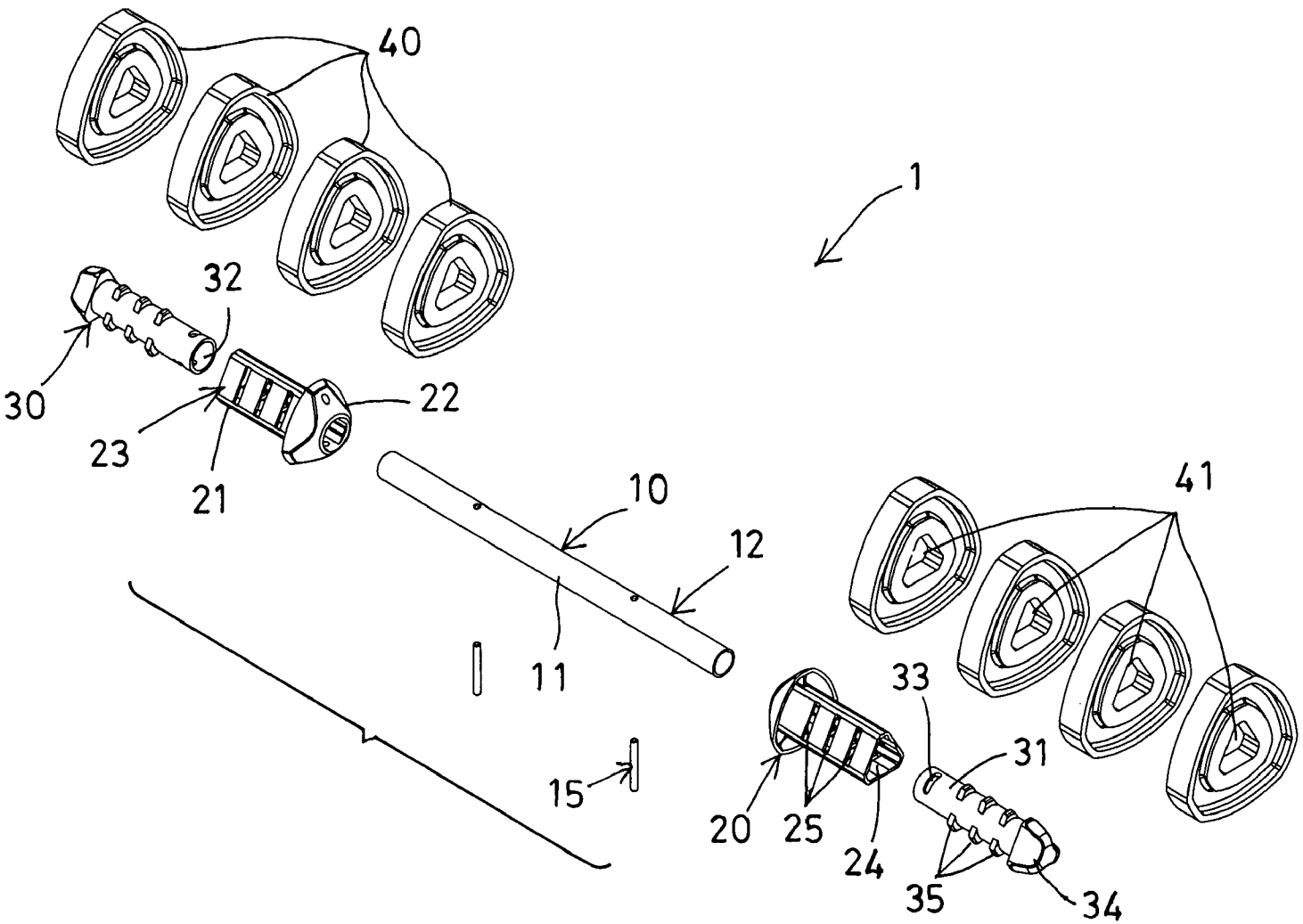
FIG. 1 is a partial exploded view of an adjustable barbell or dumbbell in accordance with the present invention.
Figure 2:
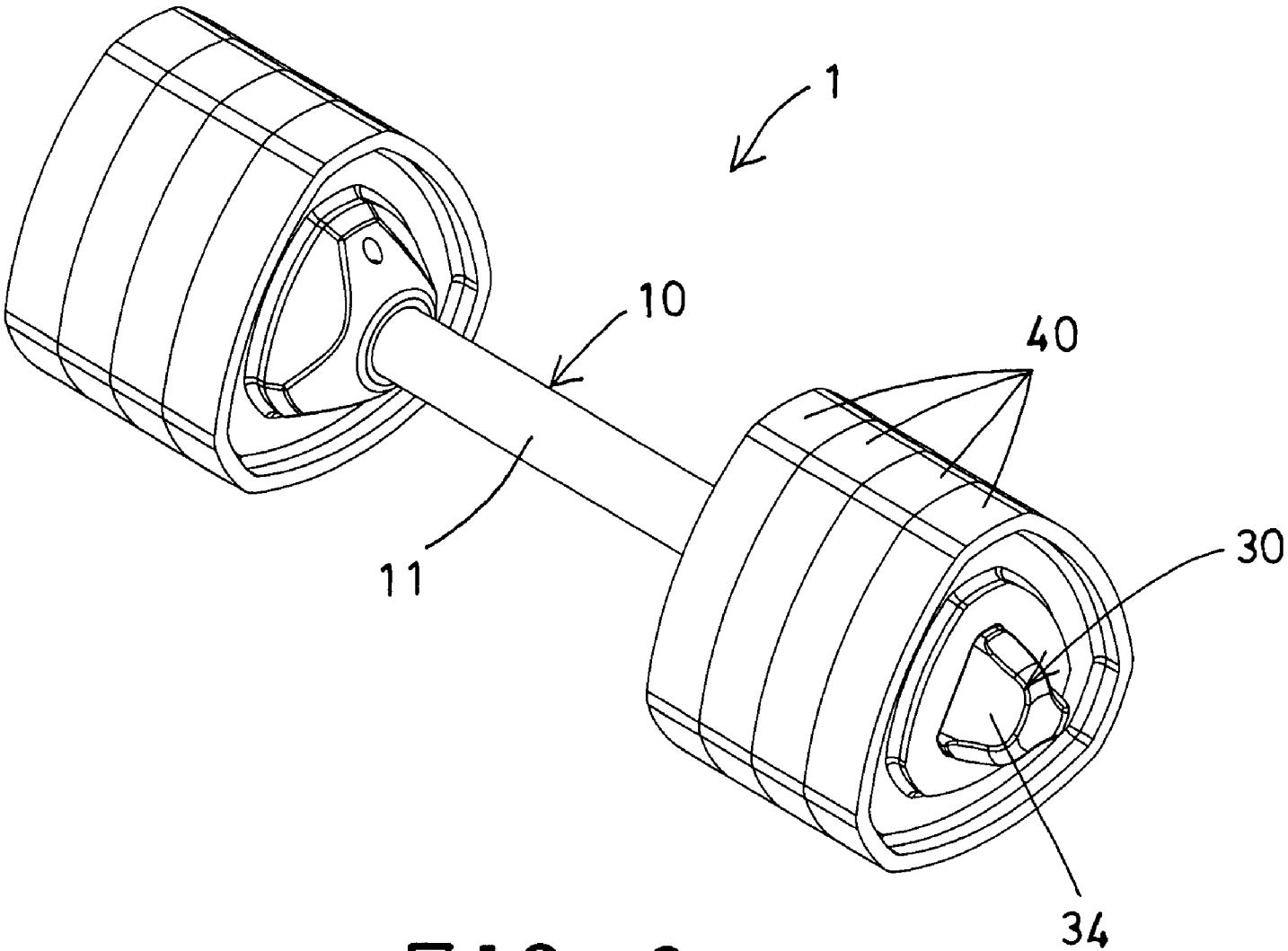
FIG. 2 is a perspective view of the adjustable barbell or dumbbell.
Figure 4:
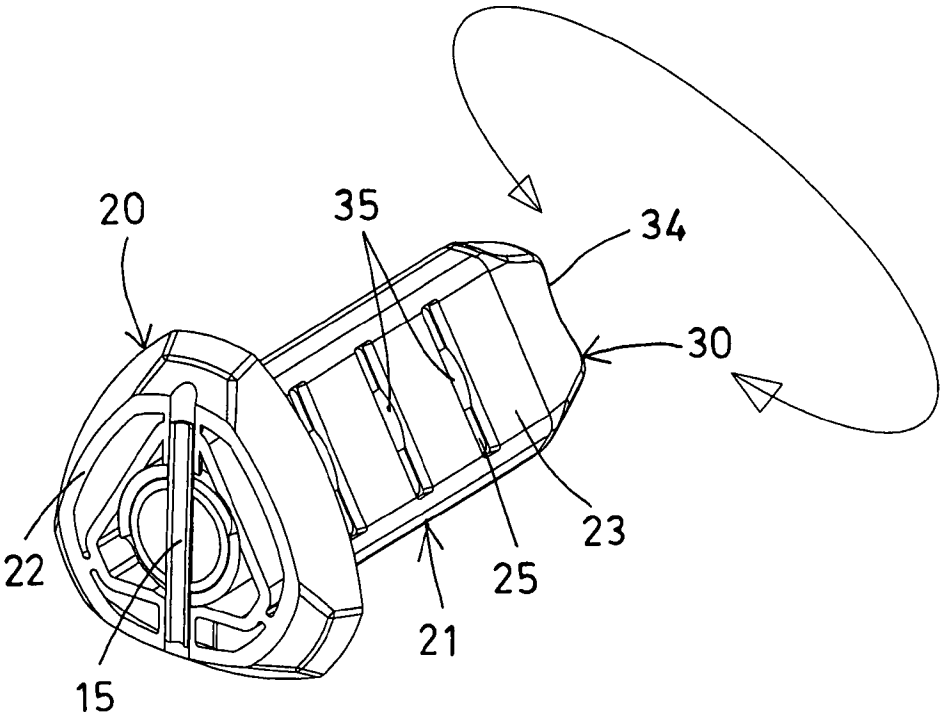
FIG. 4 is another partial perspective view illustrating the end latching or anchoring device of the adjustable dumbbell.

Referring to the drawings, and initially to FIGS. 1-4, an adjustable barbell or dumbbell or exercise device 1 in accordance with the present invention comprises a longitudinal shaft or handle 10 including a hand grip 11 formed or provided on the center portion thereof for being grasped or held by the users and for carrying or lifting or moving the handle 10 and for allowing the adjustable dumbbell 1 to be easily operated by the users, and including two end portions 12.

Two end members or carriers 20 are each attached or secured to each of the end portions 12 of the handle 10 with one or more welding portions or latches or fasteners (not shown), adhesive members, or lock pin members 15, and each include a tubular member 21 attached or secured onto the end portion 12 of the handle 10, and each include an anchor or base plate 22 arranged or located at the inner portion thereof and having an outer diameter greater than that of the tubular member 21, and each include one or more (such as three) notches or cut-off portions 23 formed or provided therein for forming or defining a non-circular or triangular cross section.

The carriers 20 each further include a chamber 24 formed therein (FIG. 1), and one or more slots 25 formed therein and communicative with the chamber 24 thereof, in which the slots 25 are preferably formed or located at or in the cut-off portion 23 of the carrier 20. It is preferable, but not necessarily that the lock pin members 15 are engaged with or through the anchor plate 22 and extended through the chamber 24 of the tubular member 21 (FIGS. 3, 6) for stably or solidly attaching or mounting or securing or coupling the tubular members 21 of the carriers 20 to the end portions 12 of the handle 10.

Figure 5:
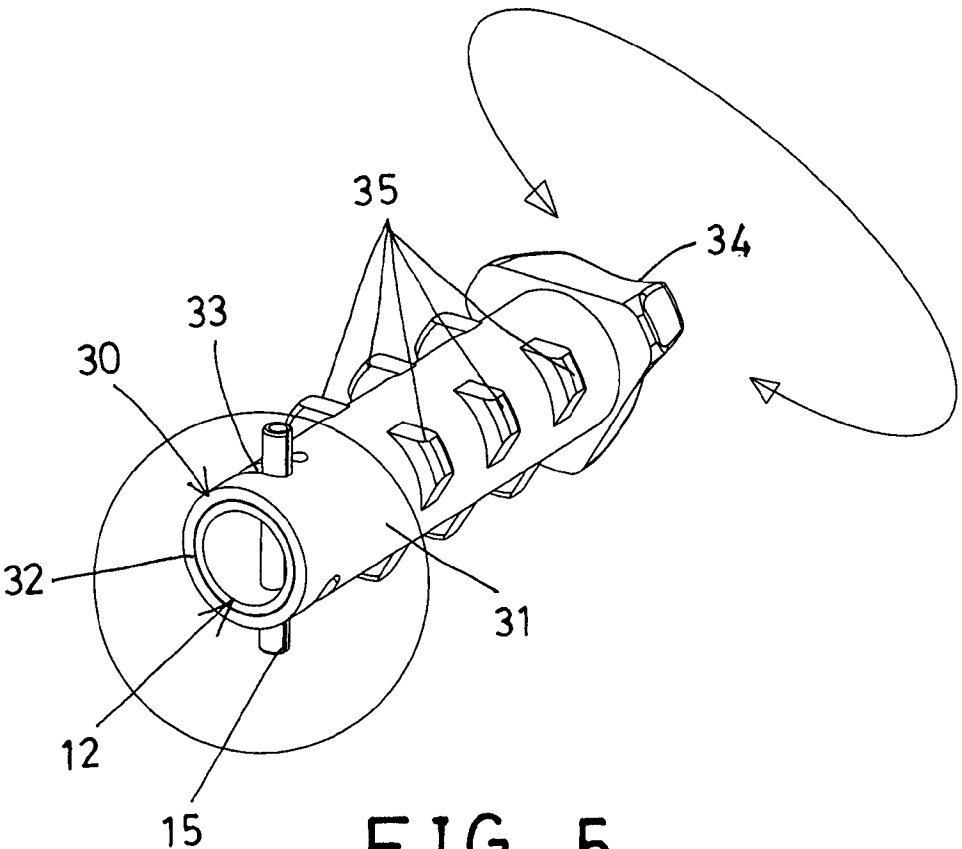

A rotatably latch member 30 includes a shank 31 pivotally or rotatably attached or mounted or engaged into the chamber 24 of the tubular member 21, and includes a bore 32 formed therein (FIGS. 1, 4-5) for receiving or engaging with the end portion 12 of the handle 10, and includes one or more (such as two) opposite grooves 33 formed therein for slidably receiving or engaging with the lock pin member 15 and for pivotally attaching or mounting or securing the latch member 30 to the carrier 20 and the end portion 12 of the handle 10 and for limiting the latch member 30 to rotate relative to the carrier 20 and the end portion 12 of the handle 10.

Figure 6:
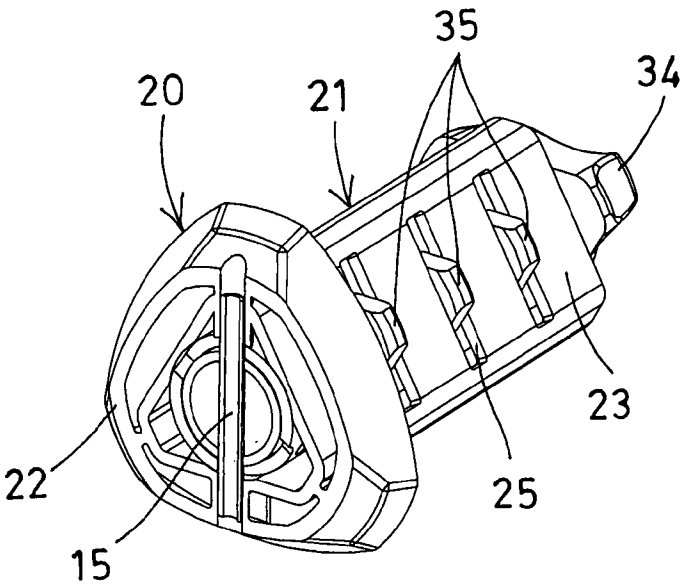
FIGS. 5, 6 are further partial perspective views similar to FIGS. 4 and 3 respectively illustrating the operation of the adjustable dumbbell.
Figure 8:
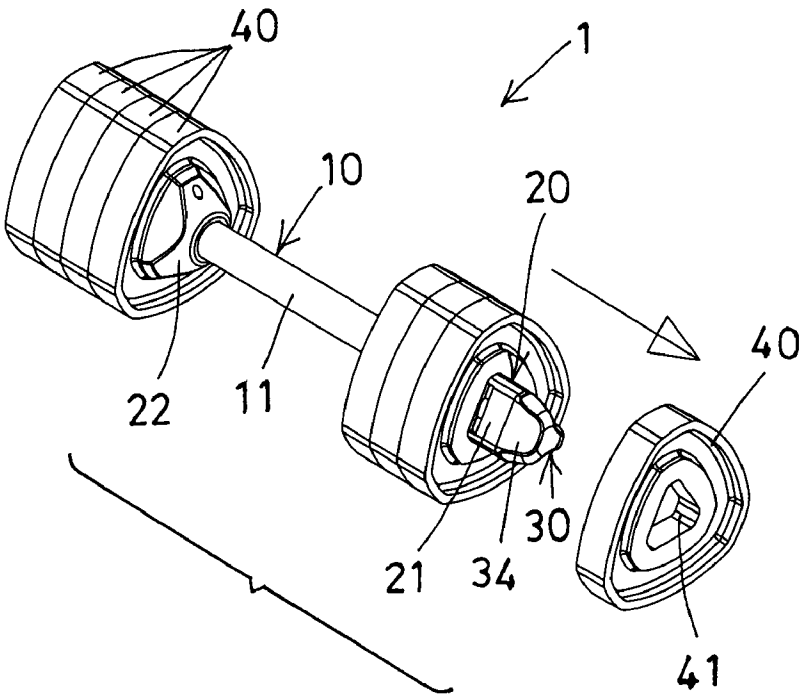
FIGS. 8, 9 are further partial exploded views illustrating the operation of the adjustable dumbbell.
Figure 7:
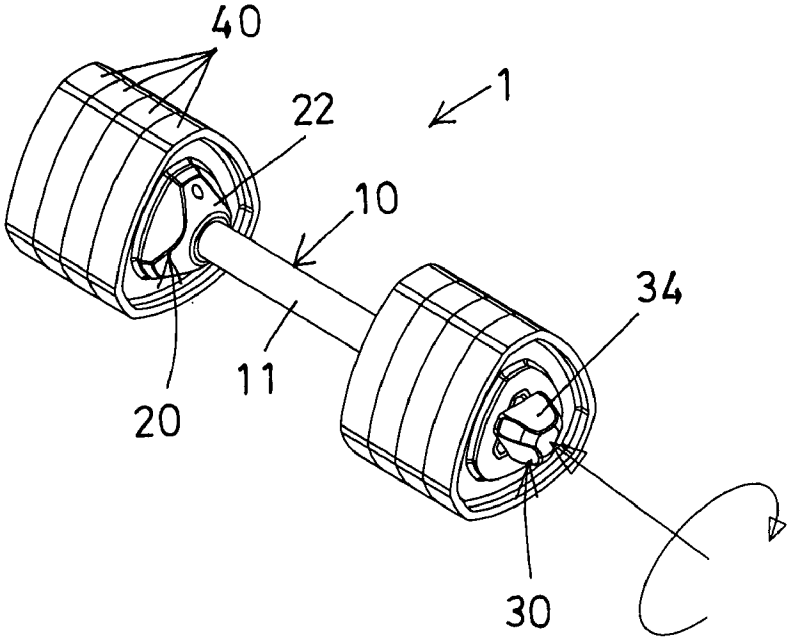
FIG. 7 is a further perspective view similar to FIG. 2, illustrating the operation of the adjustable dumbbell.
Figure 9:
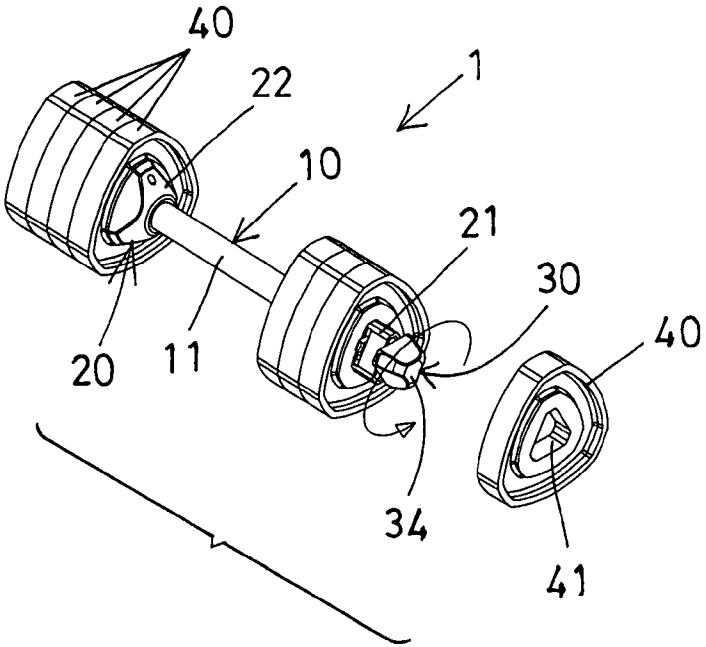

The latch member 30 includes a head or knob 34 formed or provided on one end or outer end of the shank 31 and having an outer diameter greater than that of the shank 31, but having an outer contour similar or identical to that of the tubular member 21 of the carrier 20 for selectively flushing or aligning with the tubular member 21 of the carrier 20 (FIGS. 2-3, 8), and the latch member 30 is selectively rotatable relative to the carrier 20 and the handle 10 to an interlock or interlace or staggered or crisscross status or position as shown in FIGS. 6-7, and 9.

Figure 3:
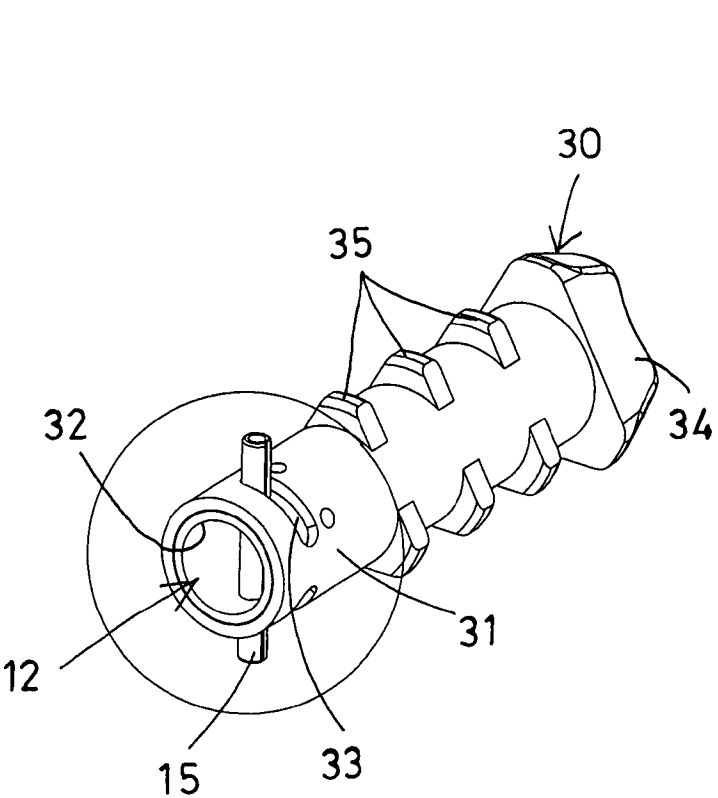
FIG. 3 is a partial perspective view illustrating the end latching or anchoring device of the adjustable dumbbell.

The latch member 30 further includes one or more (such as three) rows of latch tongues 35 extended outwardly therefrom and aligning with the slots 25 of the carrier 20 respectively for selectively extending out through the slots 25 of the carrier 20 respectively (FIGS. 6, 9), or for selectively receiving or engaging in the tubular member 21 of the carrier 20 (FIGS. 3, 8).

A number of weight plates or weight members 40 each include an opening 41 formed therein, such as formed in the middle or central portion thereof and having a non-circular or triangular cross section similar or identical to that of the tubular member 21 of the carrier 20 for slidably receiving or engaging with the tubular member 21 of the carrier 20 and for allowing the weight members 40 to be selectively attached or mounted or engaged onto the tubular member 21 of the carrier 20 and for preventing the weight member 40 from being rotated relative to the carrier 20.

In operation, as shown in FIGS. 3 and 8, the selected or the required number of the weight members 40 may be easily and quickly engaged onto the carrier 20 or disengaged from the carrier 20 when the knob 34 of the latch member 30 is flush or aligned with the tubular member 21 of the carrier 20 and when the latch tongues 35 of the latch member 30 are selectively received or engaged in the tubular member 21 of the carrier 20.

After the selected or the required number of the weight members 40 are engaged onto the carrier 20, the knob 34 of the latch member 30 may be pivoted or rotated relative to the carrier 20 and the handle 10 to the interlock or interlace or staggered or crisscross status or position as shown in FIGS. 6-7 and 9, at this moment, the latch tongues 35 of the latch member 30 are extended out through the slots 25 of the carrier 20 and engaged with the weight members 40 for stably latching or anchoring or locking or securing or retaining the weight members 40 to the carrier 20 and the handle 10, and for preventing the weight members 40 from being disengaged from the handle 10.

Figure 10:
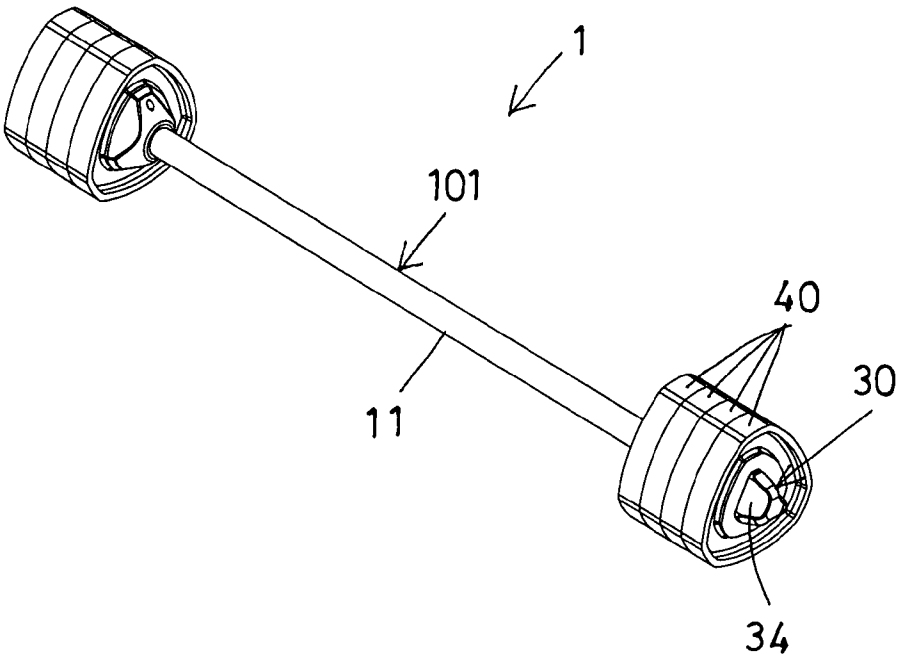
FIG. 10 is a still further perspective view illustrating the other arrangement of the adjustable dumbbell.

It is to be noted that the selected or the required number of the weight members 40 may be easily and quickly engaged onto the carrier 20 and the handle 10, and may be easily and quickly locked or secured to the carrier 20 and the handle 10 with the latch member 30, such that the weight members 40 may be changeably and easily and quickly mounted or attached to the carrier 20 and the handle 10. The weight members 40 may thus be easily and quickly engaged onto the carrier 20 or disengaged from the carrier 20 by pivoting or rotating the latch member 30 relative to the carrier 20 and the handle 10. As shown in FIG. 10, the size or length or dimension of the handle 101 and/or the weight members 40 may be enlarged to form and to act as a barbell.

Accordingly, the adjustable barbell or dumbbell or exercise device in accordance with the present invention includes an improved structure for allowing the weight members to be easily and adjustably attached to or disengaged from the weight carrier or handle and for allowing the adjustable dumbbell to be easily operated by the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

What is claimed is:

1. An adjustable exercise device comprising: a handle including two end portions, two carriers each including a tubular member attached to said end portion of said handle respectively, and each including a chamber formed therein, and each including a plurality of slots formed therein and communicative with said chamber of said tubular member, a plurality of weight members each including an opening formed therein for slidably receiving said tubular member of said carrier and for engaging onto said tubular member of said carrier, and two latch members each including a shank engaged into said chamber of said tubular member, and each including a plurality of latch tongues extended outwardly therefrom and aligned with said slots of said carrier respectively, and said latch member being rotatable relative to said carrier and said handle for selectively extending said latch tongues out through said slots of said carrier respectively and for selectively engaging with said weight members and for anchoring and latching said weight members on said carrier and said handle, and said latch member being rotatable relative to said carrier and said handle for selectively engaging said latch tongues into said tubular member of said carrier and for allowing said weight members to be selectively attached to and disengaged from said carrier and said end portion of said handle; wherein said handle includes a pin member engaged with said shank of said latch member for limiting said latch member to rotate relative to said carrier and said handle; and wherein said latch member includes two opposite grooves formed in said shank for slidably engaging with said lock pin member and for pivotally attaching said latch member to said carrier and said handle and for limiting said latch member to rotate relative to said carrier and said handle.

2. The adjustable exercise device as claimed in claim 1, wherein said carriers each include a base plate provided on one end of said tubular member and having an outer diameter greater than that of said tubular member.

3. The adjustable exercise device as claimed in claim 1, wherein said tubular members of said carriers each include a non-circular cross section having at least one cut-off portion formed therein.

4. The adjustable exercise device as claimed in claim 1, wherein said latch member each include a bore formed therein for receiving and engaging with said end portion of said handle.

* * * * *